US005627503A

United States Patent [19]

Mader

[11] Patent Number: 5,627,503

[45] Date of Patent: May 6, 1997

[54] RELAY

[75] Inventor: Leopold Mader, Mödling, Austria

[73] Assignee: Eh-Schrack Components Aktiengesellschaft, Vienna, Austria

[21] Appl. No.: 544,382

[22] Filed: Oct. 10, 1995

[30] Foreign Application Priority Data

Oct. 10, 1994 [AT] Austria ..... 1911/94

[51] Int. Cl.[6] ..... H01H 51/22

[52] U.S. Cl. ..... 335/78; 335/80

[58] Field of Search ..... 335/78–88, 124, 335/128, 132, 131

[56] References Cited

U.S. PATENT DOCUMENTS 5,394,127 2/1995 Hendel ..... 335/128

FOREIGN PATENT DOCUMENTS 382739 8/1986 Austria .
0118097 1/1985 European Pat. Off. .
1163270 4/1958 France .
941547 4/1956 Germany .
7529555 9/1975 Germany .
2614943 10/1977 Germany .
3009718 9/1981 Germany .
9303437 8/1993 Germany .

*Primary Examiner*—Lincoln Donovan
*Attorney, Agent, or Firm*—Henry M. Feiereisen

[57] ABSTRACT

A relay includes a base member that supports a magnetic system and has an armature pivoted on a bearing edge on the base member. The armature has a free end moveable in an actuation direction on the bearing edge relative to a pole face between a release position and an attracted position upon energizing and deenergizing of the coil, whereby the bearing edge extends in the plane of a second pole face. Received by a support area of the armature is a retention spring for holding the armature in contact with the bearing edge, with the retention spring being formed as a carrier bilaterally clamped at attack points which are substantially in alignment at least in one plane with the support area for the retainer spring.

13 Claims, 9 Drawing Sheets

RELAY

BACKGROUND OF THE INVENTION

The present invention refers to a relay, and in particular to a relay including a base member that supports a magnetic system and has an armature pivoted on a bearing edge of the base member and having a free end movable in an actuation direction on the bearing edge relative to a pole face between a release position and an attracted position upon energizing and deenergizing of the coil, with the bearing edge extending in the plane of a second pole face, and with a retention spring being received at a support area of the armature for holding the armature in contact with the bearing edge.

German pat. no. DE-A1 30 09 718 discloses an electromagnetic relay with a retention spring in form of a leaf spring that has a long resilient leg and pushes at this end via a semicircular impression the armature via an embossed surface in the armature bend onto the blade of the yoke. Lateral projections precisely position the armature in its lateral position upon the yoke.

Conventional relays of this type have the drawback that the manufacture of the retention springs is relatively material-intensive and cost-intensive because their typically complicated configuration makes it difficult to keep proper dimensions and requires three-dimensional deformations of pre-fabricated spring blanks. This is in particular true in case the retention spring should generate a recoil torque for loading the armature into the release position in addition to generating a force for securing the armature upon the bearing.

SUMMARY OF THE INVENTION

It is thus an object of the present invention to provide an improved relay obviating the aforestated drawbacks.

In particular, it is an object of the present invention to provide an improved relay which enables a production and assembly of the retention spring in a simple manner.

These objects and others which will become apparent hereinafter are attained in accordance with the present invention by providing the retention spring in form of a carrier that is bilaterally clamped at pertaining attack points which extend substantially in alignment at least in one plane with the support area for the retention spring.

In this manner, the retention spring can be designed in a very simple and material-saving manner compared to the complex configurations of prior art retention springs. Suitably, the retention spring is formed as leaf spring so that the retention spring can be flat and does not require a pre-fabricated deformation, thereby significantly simplifying the overall production process.

According to another feature of the present invention, the support area of the retention spring and the attack points are offset to each other in a vertical direction so that the retention spring arches, when the relay is assembled. The thus created bending load provides the force required to generate the torque for returning the armature to the release position without resorting to a pre-arched spring.

Advantageously, the support area of the armature for the retention spring is formed by a surface that is sloped relative to the pole face in a direction away from the pole face towards the outside of the armature. The inclination of this surface ensures that the force exerted by the retention spring upon this support area effects a force component that acts in direction towards the pole face so that a displacement of the armature is prevented. At the same time, the force exerted by the retention spring onto the armature effects the torque which loads the armature into its release position and is defined by the distance between the bearing edge, that coincides with the plane of the pole face, and the support area of the armature for the retention spring.

Preferably, the sloped surface is formed by a truncated cone shaped aperture.

According to another feature of the present invention, the retention spring has an essentially E-shaped configuration, with a central web forming a resilient tongue for support of the retention spring in the truncated cone shaped aperture of the armature, and with axial ends formed with snap-in lugs for engagement in the base member. This configuration results in a retention spring that is simple and cost-efficient to produce and permits a securement of the armature while at the same time assuring the generation of a rebound torque which loads the armature in a direction seeking the release position. Suitably, the snap-in lugs of the retention spring are received in complementary pockets of the base member which carries the magnetic system. Thus, the base member can be formed as a single piece that includes the pockets for receiving the snap-in lugs of the retention spring so that no further components need to be made and assembled. It is thereby easily possible to provide the aperture with one wall section that extends at an acute angle and is necessary for advantageously dividing the effective force exerted by the retention spring. Furthermore, the round configuration of the aperture also prevents a lateral displacement of the armature.

According to a further feature of the present invention, the bearing edge that supports the armature is formed by two or more wedged elevations of the base member. The thus created wedged surfaces receive one end face of the armature in its release position. This type of support stabilizes the release position of the armature while the attracted position is only maintained so long as the coil of the magnetic system is energized.

According to another feature of the present invention, the armature has laterally protruding side portions which bear upon projecting stops on the top face of base member in the release position of the armature. Thus, the torque as generated by the retention spring returns the armature to its release position only over a predetermined angle of rotation, with the armature being pressed against the projecting stops of the base member to maintain the release position.

The retention spring may be formed as a leaf spring of continuous rectangular cross section that is centrally supported upon a projecting platform of the armature, with the platform exhibiting a sloped surface in relation to the pole face. Also in this manner, a very simple and easily to produce configuration of the retention spring is achieved. Alternatively, the retention spring may be formed as wire spring of continuous circular cross section that extends between two attack points and is supported centrally upon a projecting platform of the armature. This configuration enables the formation of a torque in a particular space-saving manner.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
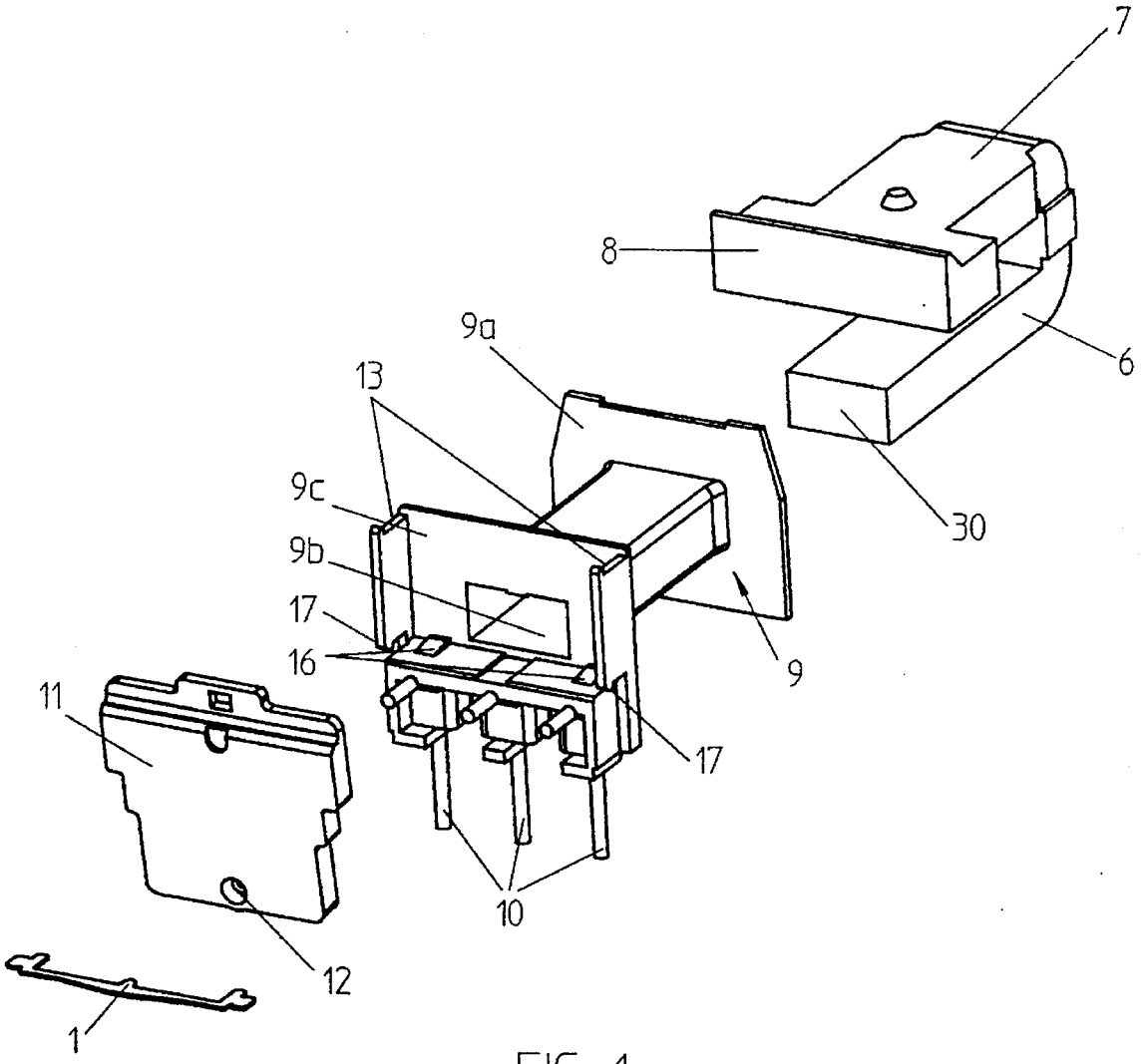
FIG. 1 is an exploded, perspective illustration of a relay according to the present invention.

Turning now to the drawing, and in particular to FIG. 1, there is shown an exploded perspective view of one embodiment of an electromagnetic relay according to the present invention, including a base member in form of a coil carrier, generally designated by reference numeral 9 which carries a coil (not shown) between collars 9*a*, 9*b*. Protruding downwards from the collar 9*b* are the winding terminals 10 for the electric connection to the coil and to the contact arrangement (not shown) by which an armature 11 is actuated. Insertable in the base member 9 through opening 9*c* is a core 6 which defines at its free end a pole face 30 and is part of the magnetic system that further includes a yoke 7 which defines at its free end a pole face 8.

The armature 11 is held by a retention spring 1 on a support surface or bearing edge 16 of the base member 9 and has a free end movable in an actuation direction on the bearing edge 16 between a release position and an attracted position relative to the pole face 8 upon energizing and deenergizing of the coil. The support surface 16 extends essentially in the plane of the pole face 30 and supports one end face of the armature 11 in its release position, with the retention spring 1 engaging an aperture 12 of the armature 11 for support therein and for securing the armature 11 in direction of the longitudinal extension of the bearing edge 16. When energizing the coil, the armature 11 is attracted to bear with its free end upon the pole face 8 while in the release position, an air gap is defined between the armature 11 and the pole face 8.

Figure 3:
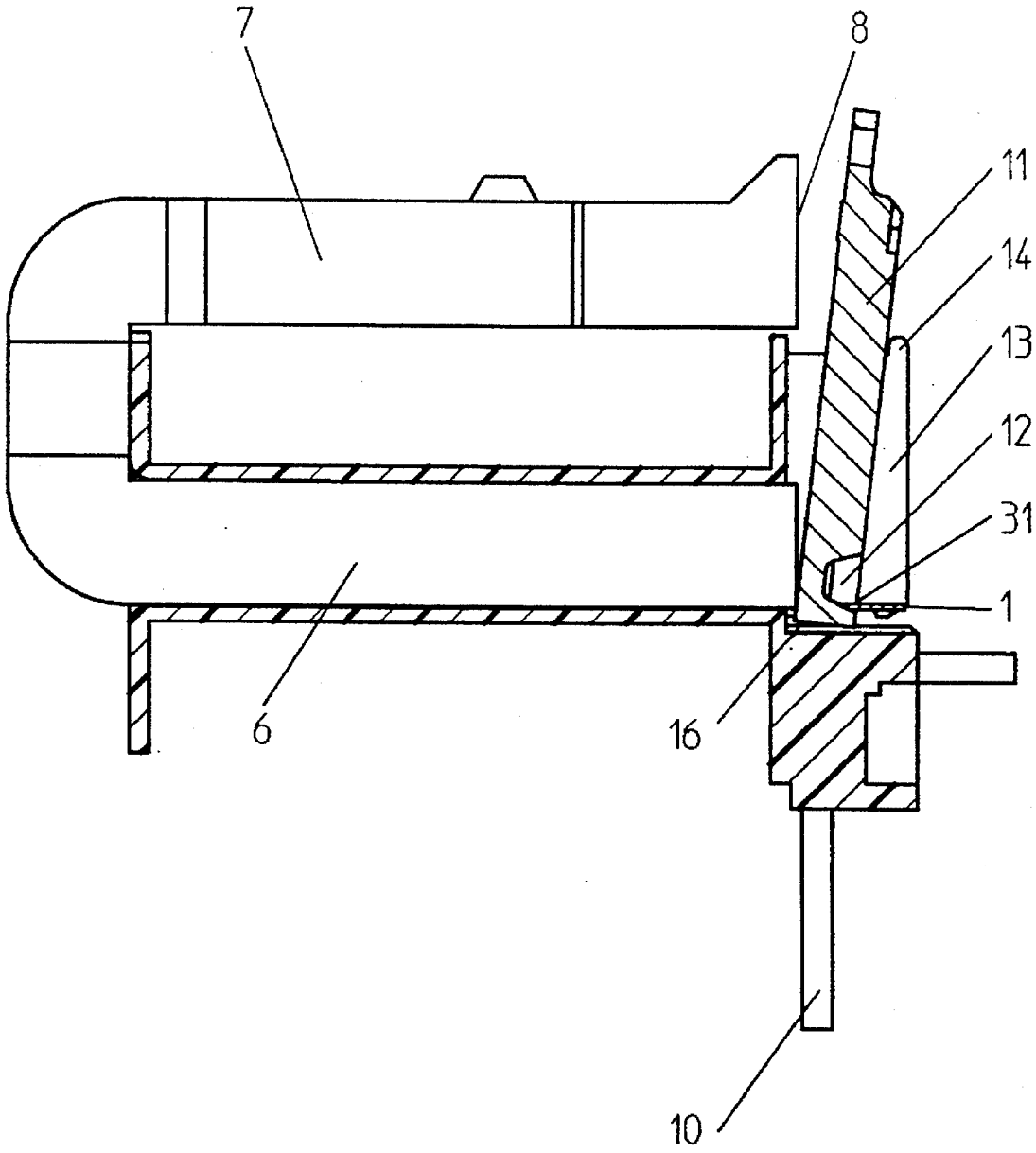
FIG. 3 is a longitudinal section of the relay according to FIG. 1, with the relay being assembled.
Figure 3A:
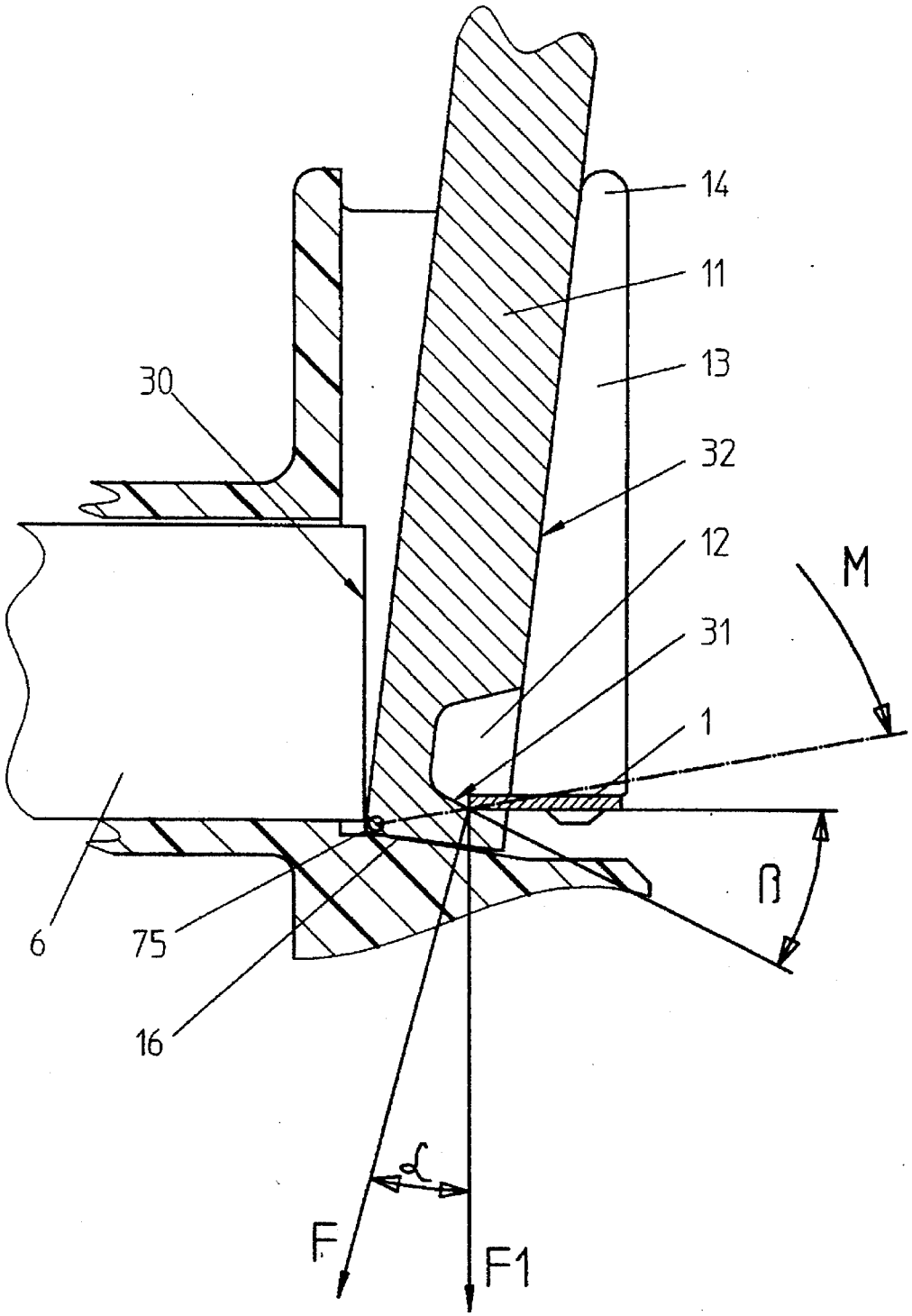
FIG. 3*a* is a fragmentary, partially sectional view of the relay of FIG. 3, showing in detail the connection of the armature relative to the pole face, with the armature occupying the release position.

As shown in particular in FIG. 3*a*, the aperture 12 is formed with a support area 31 which receives the retention spring 1 and extends at an angle to the direction of the force F1 exerted by the retention spring 1 so that the retention spring 1 exerts a torque by which the armature 11 is loaded to seek the release position. The support area 31 is sloped in direction away from the pole face 30 of the yoke 6 towards the outside 32 of the armature 11 and defines an angle $\beta$ with the plane of the retention spring 1. The force F resulting from the inclination of the support area 31 loads the armature 11 in direction of its release position with a torque, as indicated by arrow M.

Figure 5:
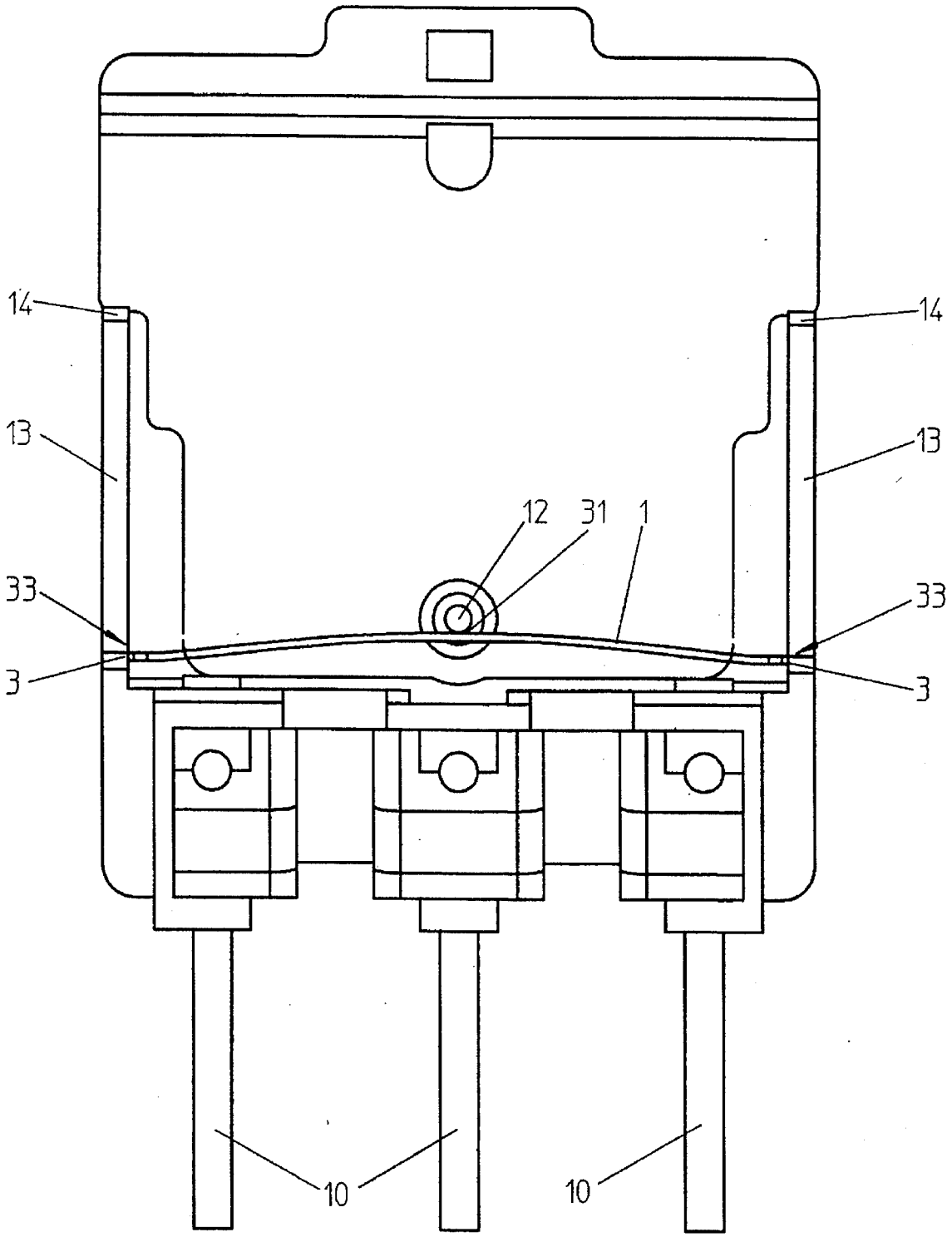
FIG. 5 is a side view of the relay according to FIG. 1.

Before assembling the base member 9 and before being attached to the armature 11, the retention spring 1 is completely flat and is arched only after being forced for attachment between lateral walls 13 formed on the collar 9*b* of the base member 9 at respective attack points 33, whereby the support area 31 in the aperture 12 extends vertically offset in relation to the axial attack points 33. The retention spring I is provided in form of a leaf spring which is supported centrally by the support area 31 of the aperture 12. As indicated in FIG. 5, the support area 31 of the aperture 12 is formed by a wedged impression of the armature 11.

Persons skilled in the art will understand that the retention spring 1 may be formed in various configurations. For example, the retention spring may be clamped centrally instead of laterally, as shown in the drawing, or may be provided with a differently arched configuration. Also, the spring may be prefabricated with an arching, and/or the support area 31 need not necessarily be vertically offset relative to the attack points 33.

Figure 2:
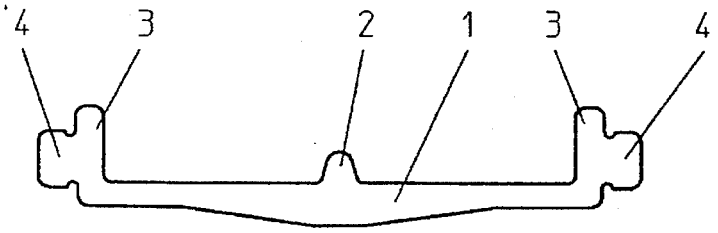
FIG. 2 is a schematic top view of a retention spring according to the present invention, for use in the relay of FIG. 1.

Referring now to FIG. 2, there is shown a detailed illustration of a retention spring 1 of flat, E-shaped configuration, with a central web forming a resilient tongue 2 by which the retention spring 1 is supported in the aperture 12 of the armature 11 on the wedged support area 31. At its axial ends, the retention spring I terminates in snap-in lugs 4 which engage the attack points 33 formed at the opposing side walls 13 of the stationary base member 9. Although not shown in the drawing in detail, the resilient tongue 2 may be provided with lateral projections for additionally securing the armature 11 from lateral displacement. It may also be possible to form the aperture 12 with complementary recesses or with projections to prevent such a displacement.

Figure 4:
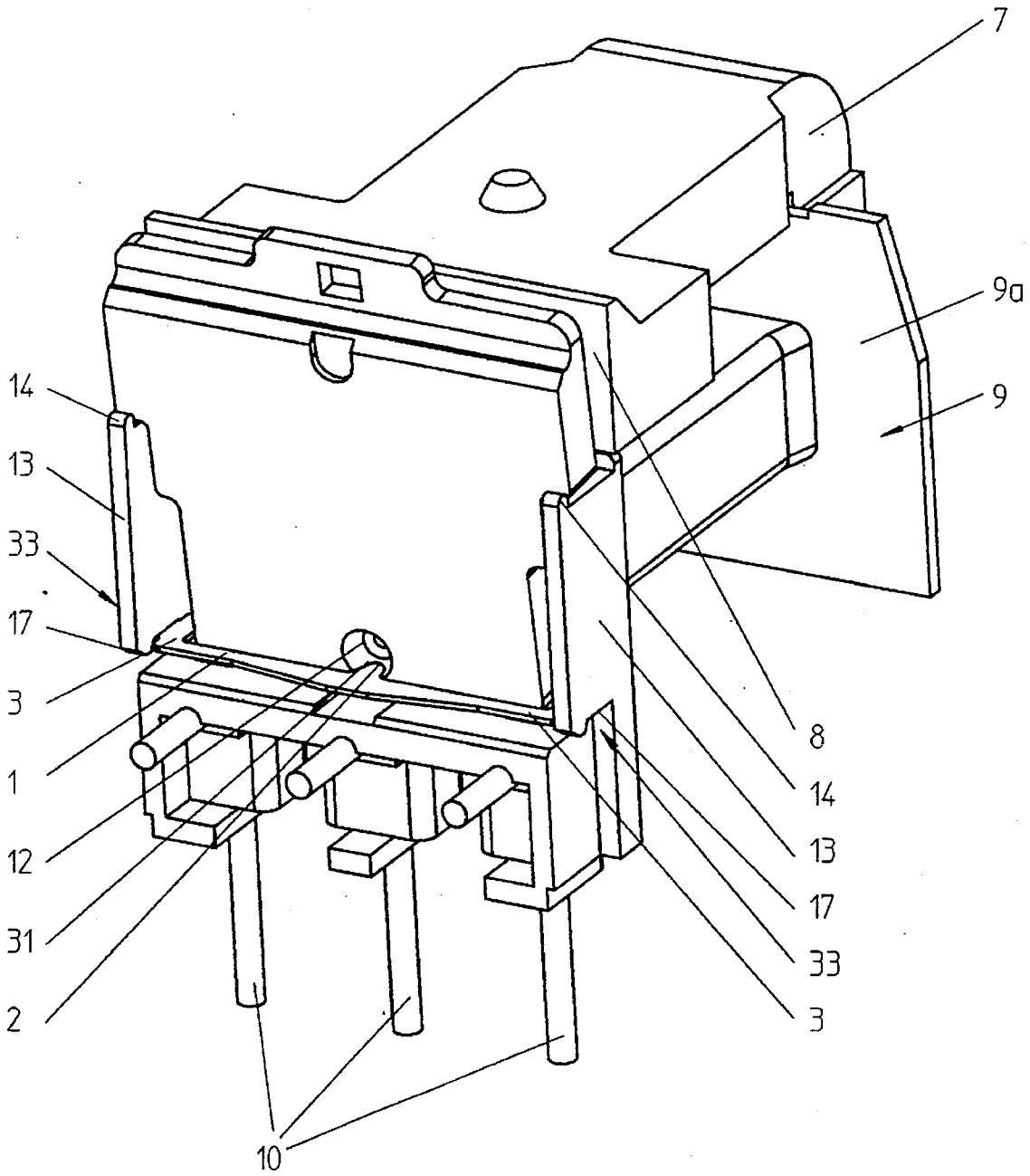
FIG. 4 is a perspective illustration of the relay of FIG. 1, with the relay being assembled and the armature occupying the release position.

As further shown in FIGS. 1 and 4, the side walls 13 of the collar 9*b* are formed with pockets 17 for engagement by the snap-in lugs 4 of the retention spring 1. The snap-in lugs 4 may be shaped in any desired configuration so long as they enable a securement of the retention spring 1 at its axial ends 3. Also the configuration of the resilient tongue 2 may vary as long as an engagement in the aperture 12 of the armature 11 is effected such that the resulting arching of the retention spring 1 provides the force for a rebound torque by which the armature 11 is urged in direction of the release position.

As shown in FIG. 4, the retention spring 1 is formed as a bilaterally clamped and supported carrier, with the attack points 33 and the support area 31 extending essentially in alignment with each other at least in one plane.

FIG. 3 shows a longitudinal section of the electromagnetic relay according to FIG. 1 in an assembled state, with the armature 11 in its release position and supported on one end face upon the wedged elevations 16 that form the support surface of the base member 9. The support area 31 of the aperture 12 which receives the resilient tongue 2 extends at an angle to the force F1 (FIG. 3*a*) that is exerted by the retention spring 1 to urge the armature 11 into the release position by the generated torque M.

FIG. 3*a* also shows a force diagram as attained by the attachment of the retention spring 1 to the base member 9 and the armature 11, illustrating a force F1 exerted through deformation by the retention spring 1, with one force component F that generates the torque by which the armature 11 seeks the release position defining an angle $\alpha$ with force F1. The aperture 12 of the armature 11 is formed by a truncated cone shaped impression; however, any other configuration of the impression may be provided so long as one area extends at an angle relative to the effective force F. The round configuration of the aperture 12 prevents the armature 11 from being laterally displaced because the resilient tongue 2 is positionally stable only when occupying the lowermost position in the aperture 12. A lateral deflection of the armature 11 is counteracted by the ascending curvature of the aperture 12 through centering forces acting upon the armature 11.

In order to improve the support of the armature 11 and facilitate its rotational motion upon the bearing edge 16, the extreme edge 75 of the armature 11 that pivots upon the support surface 16 of the base member 9 is of rounded configuration (FIG. 3*a*).

FIG. 4 clearly shows the support of the resilient tongue 2 of the retention spring 1 upon the support area 31 of the aperture 12, and the attack points 33 of the retention spring 1 that are defined by the pockets 17 in the side walls 13 of the collar **9*b* so that upon attachment, the retention spring 1 is arched along the longitudinal axis thereof. The retention spring 1 is thus under a bending load for effecting the force F in downward direction towards the support area 31 of the aperture 12. When energizing the coil and attracting the armature 11, the retention spring 1 is subjected to an even further flexure so that the magnetic field has to generate an even greater attraction force in opposition to the torque by which the armature 11 is urged by the retention spring 1 into the release position. When deenergizing the coil, the armature 11** automatically returns to the release position which is maintained until re-energizing the coil.

In order to limit the rotational motion of the armature 11 into the release position, the side walls 13 of the collar **9*b* are formed at their top face with respective protruding stops 14 which are impacted by the armature 11** in the release position.

FIG. 5 is a side view of the relay according to FIG. 1, and shows in particular the arching of the retention spring 1 in an exaggerated fashion for ease of illustration. Also the protruding stops 14 at the end face of the side walls 13 are shown for support of the armature 11 in the release position.

Figure 6:
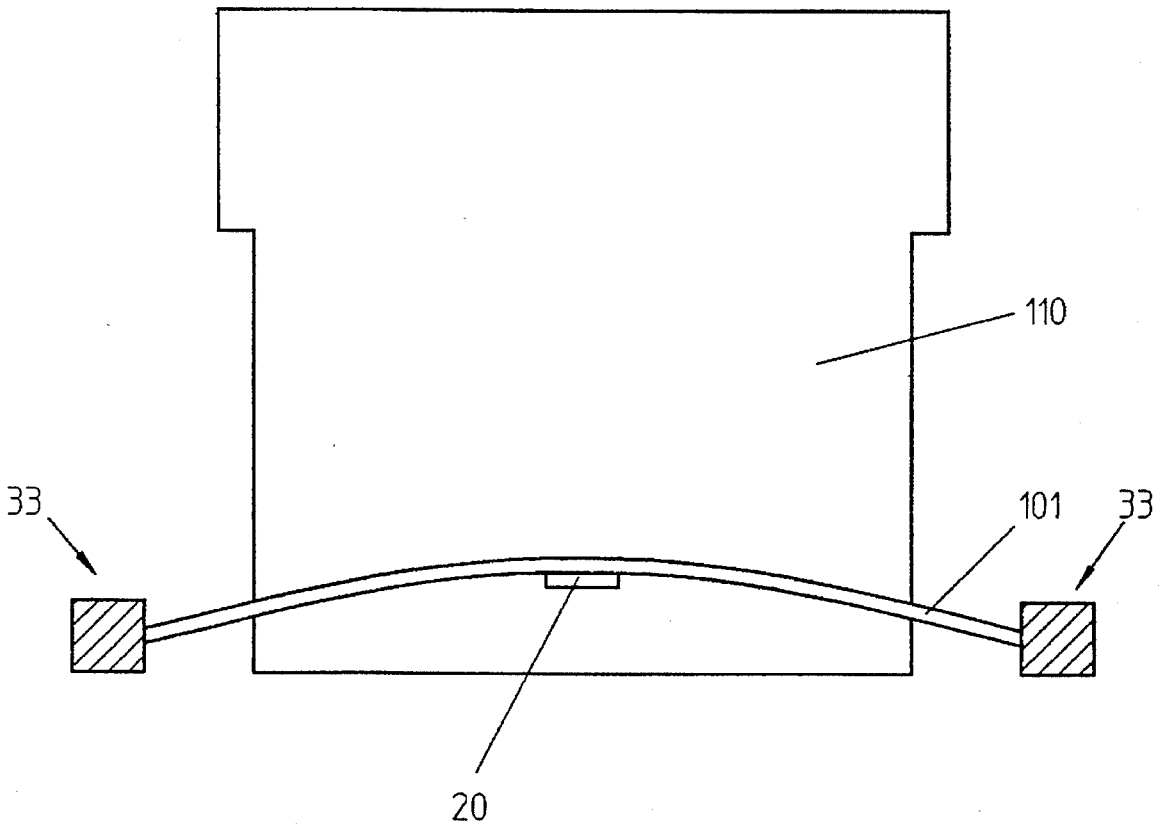
FIG. 6 is a schematic, fragmentary illustration of a further embodiment of a relay according to the present invention, illustrating in particular the connection of a retention spring to the armature.
Figure 7:
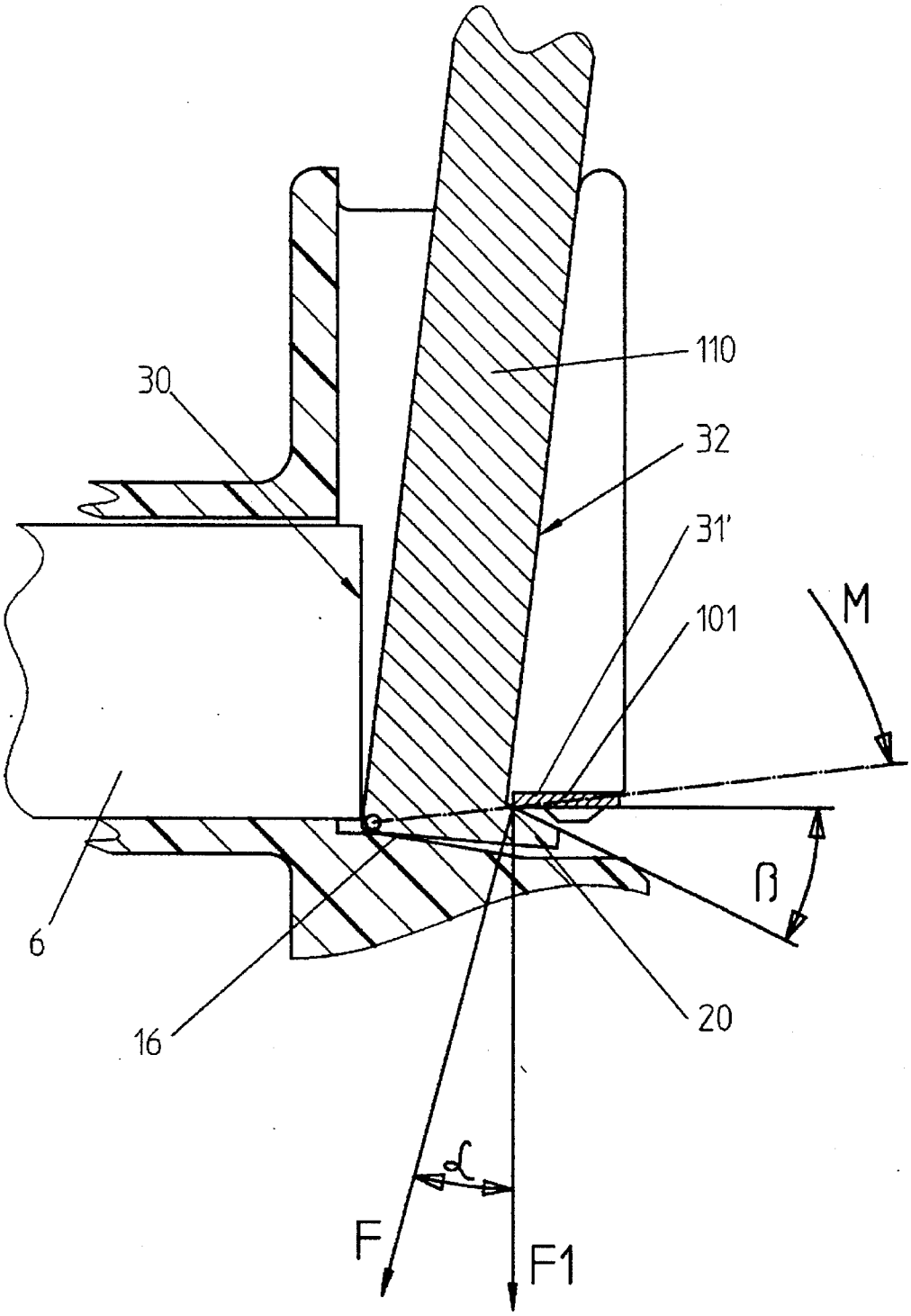
FIG. 7 is a fragmentary, partially sectional view of the relay according to FIG. 6.

Turning now to FIG. 6, there is shown a fragmentary illustration of a further embodiment of a retention spring 101 in form of a conventional leaf spring of rectangular cross section without any tongues. The armature 110 is provided at a central location thereof with a platform 20 so that the retention spring 101, when assembling the relay, is arched, with its axial ends secured at the attack points 33 of the base member 9 and extending vertically offset in relation to the platform 20 that forms the support area 31' (FIG. 7) for supporting the retention spring 101. The deflection of the retention spring 101 is effected along its longitudinal axis and parallel to the plane defined by the attack points 33 and the platform 20. The arching of the retention spring 101 is accomplished by the installation of the retention spring 101 between the attack points 33 and support on the platform 20 and generates a force by which the armature 110 is loaded to seek its release position.

The platform 20 of the armature 110 enables the configuration of the retention spring 101 without a resilient tongue. The support area 31' of the platform 20 is sloped in a direction away from the pole face 30 of the core 6 towards the outside 32 of the armature 110 in a same manner as shown in connection with the previously described embodiment, with the retention spring 101 and the support area 31' defining an angle β.

The support area 31' of the platform 20 for receiving the retention spring 101 extends at an angle to the direction of the force F1 exerted by the retention spring 101 so that the retention spring 101 urges the armature 110 into the release position by the torque, indicated by arrow M, with the force F1 being divided into its components in a manner as described with reference to the embodiment shown in FIG. 3*a*. Thus, one component effects the recoil torque while the other component effects the required pressure to secure the armature 110 from any displacement.

Persons skilled in the art will appreciate that other configurations of retention springs are possible within the scope of the present invention in order to ensure a support in an aperture or upon a platform of the armature. For example, the retention spring may be formed with a central cutout which cooperates with a complementary projection of the armature. Furthermore, it is to be understood that the retention spring need not necessarily be secured laterally. A central securement may be conceivable as well.

Figure 8:
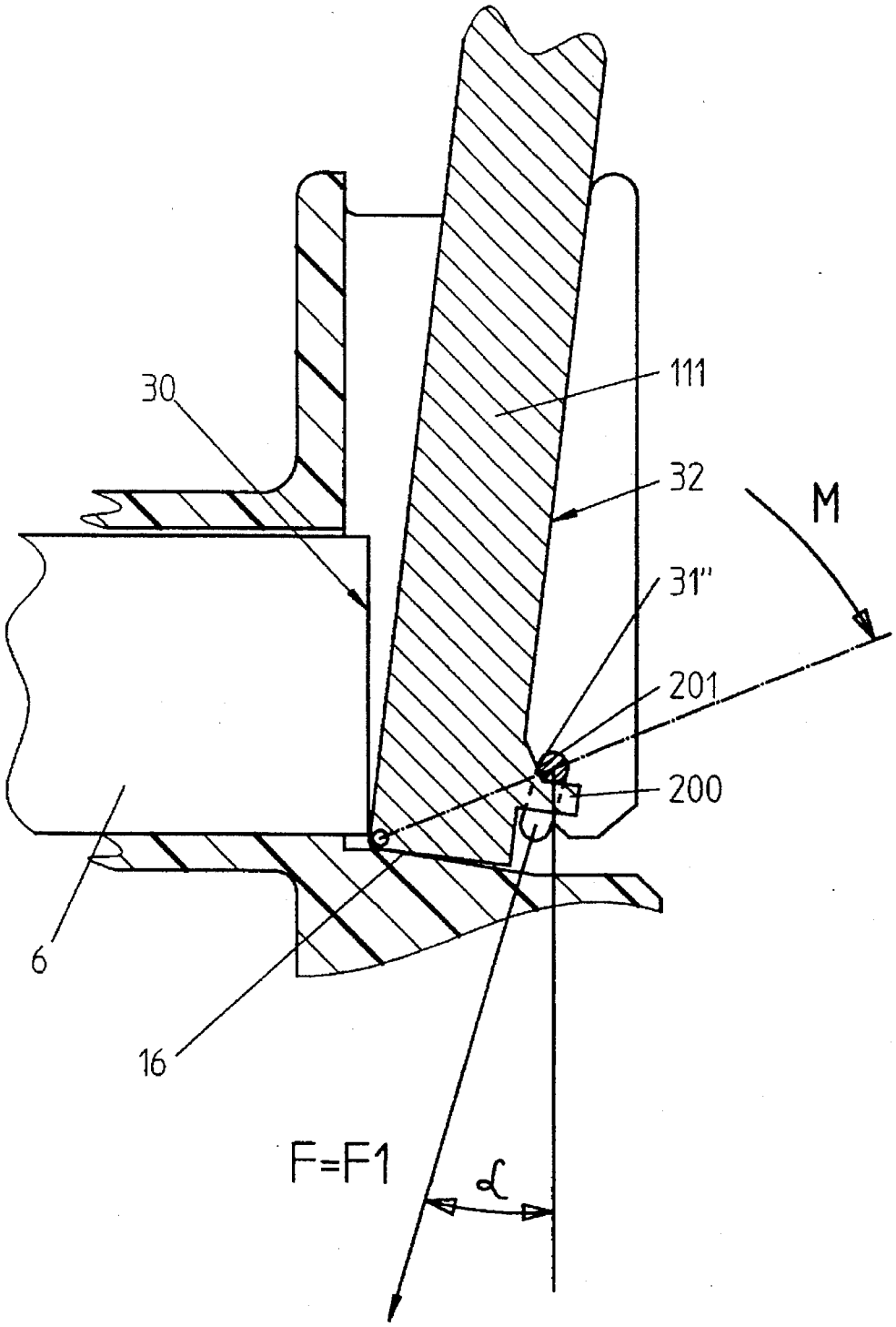
FIG. 8 is a fragmentary, partially sectional view of another embodiment of a relay according to the present invention.

FIG. 8 shows a further variation of the present invention, with a retention spring 201 in form of a wire spring which is secured between two attack points 33 and supported centrally upon a support area 31" of a platform 200 projecting from an armature 111, with the attack points being vertically offset relative to the support area 31". The circular cross section of the retention spring 201 results in each position of the armature 111 in an equality of the force F with the force F1 which generates the recoil torque and extends at an angle α relative to the vertical. In this manner, the torque for urging the armature 111 into the release position is effected in a particular space-saving manner.

Figure 9:
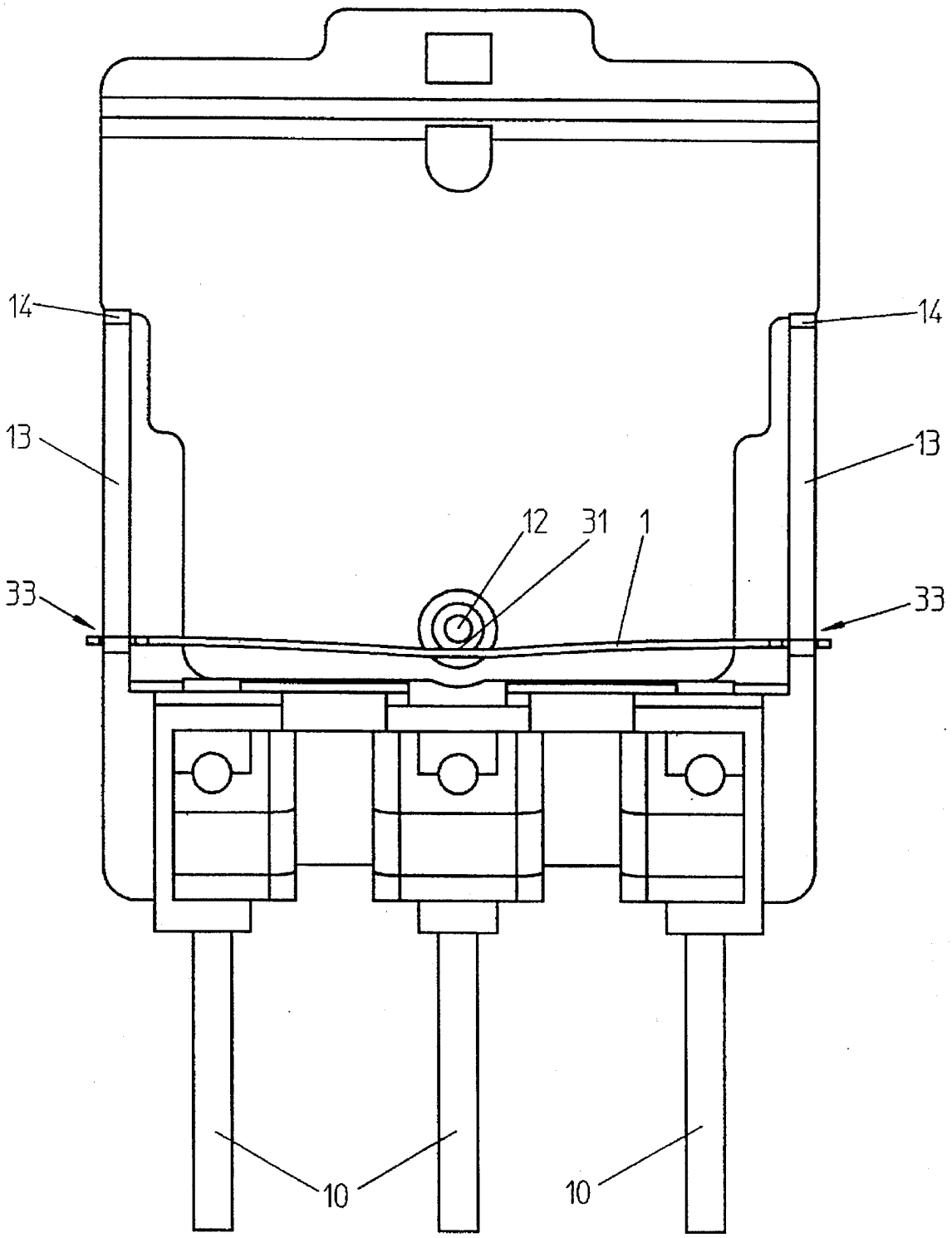
FIG. 9 is a side view of yet another embodiment of a relay according to the present invention.

FIG. 9 shows another embodiment of a relay according to the present invention in which the lateral attack points 33 of the retention spring 1 are secured to the base member 9 at a slight distance above the central support area 31, when defining the winding terminal 10 as reference point. The prefabricated retention spring 1 is slightly arched in a longitudinal direction, with both axial ends symmetrically projecting away relative to the center. This preselected arching permits a precise alignment of the attack points 33 and the support area 31 in the relay while still effecting a recoil torque for urging the armature 11 to seek the open release position and the required contact pressure to secure the armature 11 against displacement. In the assembled state, the retention spring 1 should be configured as straight as possible in longitudinal direction to improve the vibration behavior of the armature 11 and to prevent a withdrawal of the retention spring 1 from the support area 31 during strong alternating load.

While the invention has been illustrated and described as embodied in a relay, it is not intended to be limited to the details shown since various modifications and structural changes may be made without departing in any way from the spirit of the present invention.

What is claimed as new and desired to be protected by Letters Patent is set forth in the appended claims.

I claim:

1. A relay, comprising:

a magnetic system forming a support surface and including an armature defining a longitudinal axis and exhibiting an extreme edge pivotally supporting the armature on the support surface for rotation of the armature about the extreme edge relative to a first pole face in an actuation direction between a release position and an attracted position upon energizing and deenergizing of a coil of the magnetic system, with the support surface extending in the plane of a second pole face; and a retention spring received by a support area of the armature for holding the armature in contact with the support surface and acting on the armature in direction of the longitudinal axis to load the armature to seek the release position, with the support area defining the position of the armature in direction of longitudinal extension of the support surface, said retention spring being configured in form of a carrier bilaterally clamped at pertaining attack points which extend substantially in alignment at least in one plane with the support area for the retention spring.

2. The relay of claim 1 wherein the retention spring is a leaf spring.

3. The relay of claim 1 wherein the support area of the armature for the retention spring and the attack points are vertically offset to each other.

4. The relay of claim 1 wherein the support area is a sloped surface inclined relative to the second pole face in a direction away from the second pole face towards the outside of the armature.

5. The relay of claim 4 wherein the sloped surface is formed by a truncated cone shaped aperture.

6. The relay of claim 5 wherein the magnetic system includes a coil carrier, said retention spring being of essential E-shaped configuration, with a central web forming a resilient tongue for support of the retention spring on the truncated cone shaped aperture of the armature, and with axial ends formed with snap-in lugs for engagement in the coil carrier.

7. The relay of claim 6 wherein the coil carrier has pockets for receiving the snap-in lugs.

8. The relay of claim 1 wherein the coil carrier has at least two wedged elevations for forming the support surface, the elevations defining wedged faces for supporting an end face of the armature in the release position.

9. The relay of claim 1 wherein the coil carrier has a top face formed with protruding stops, said armature having projecting sides for impacting upon the stops in the release position.

10. The relay of claim 1 wherein the armature has a central platform defining a sloped surface inclined relative to the second pole face, said retention spring being formed by a leaf spring of rectangular cross section that is supported upon the platform of the armature.

11. The relay of claim 1 wherein the armature has a central platform, said retention spring being formed by a wire spring of circular cross section that is secured at two attack points and supported upon the platform of the armature.

12. A relay, comprising:

a magnetic system forming a support surface and including an armature defining a longitudinal axis and exhibiting an extreme edge pivotally supporting the armature on the support surface in an actuation direction between a release position and an attracted position upon energizing and deenergizing of a coil of the magnetic system; and a retention spring received by a support area of the armature for holding the armature in contact with the support surface and acting on the armature in direction of the longitudinal axis to load the armature to seek the release position, said retention spring being configured in form of a carrier bilaterally clamped at pertaining attack points which extend substantially in alignment at least in one plane with the support area for the retention spring.

13. The relay of claim 1 wherein the extreme edge is of rounded configuration.

* * * * *